US008541933B2

(12) United States Patent
Chowdhury et al.

(10) Patent No.: US 8,541,933 B2
(45) Date of Patent: Sep. 24, 2013

(54) TRANSPARENT THERMALLY CONDUCTIVE POLYMER COMPOSITES FOR LIGHT SOURCE THERMAL MANAGEMENT

(75) Inventors: Ashfaqul Islam Chowdhury, Cleveland, OH (US); Gary Allen, East Cleveland, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 3 days.

(21) Appl. No.: 12/979,611

(22) Filed: Dec. 28, 2010

(65) Prior Publication Data

US 2011/0169394 A1 Jul. 14, 2011

Related U.S. Application Data

(60) Provisional application No. 61/294,231, filed on Jan. 12, 2010.

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.

USPC ..... 313/46; 313/45; 313/512; 362/218; 362/294; 362/555; 362/800; 362/311.02

(58) Field of Classification Search

USPC ..... 313/498–512, 45–46; 362/218, 362/294, 373, 612, 555, 545, 249.02, 311.02, 362/800

See application file for complete search history.

(56) References Cited

U.S. PATENT DOCUMENTS

| | | | | |
|---|---|---|---|---|
| 4,211,955 | A * | 7/1980 | Ray | 315/53 |
| 6,626,557 | B1 * | 9/2003 | Taylor | 362/235 |
| 6,746,885 | B2 * | 6/2004 | Cao | 438/26 |
| 7,246,919 | B2 * | 7/2007 | Porchia et al. | 362/276 |
| 7,600,882 | B1 * | 10/2009 | Morejon et al. | 362/84 |
| 2005/0110384 | A1 * | 5/2005 | Peterson | 313/318.01 |
| 2006/0092641 | A1 * | 5/2006 | Phelan et al. | 362/294 |

(Continued)

FOREIGN PATENT DOCUMENTS

| | | |
|---|---|---|
| CN | 201 425 284 | 3/2010 |
| KR | 100 934 440 | 12/2009 |

(Continued)

OTHER PUBLICATIONS

Database WPI, Week 201024, Thomson Scientific, London, GB, AN 2010-D53350, XP002633402 & CN 201 425 284 Y (Hangzhou Create Epoch Photoelectricity Tech Co Ltd) Mar. 17, 2010, abstract, figures 1, 4, 5.

(Continued)

*Primary Examiner* — Anne Hines
*Assistant Examiner* — Jose M Diaz
(74) *Attorney, Agent, or Firm* — Fay Sharpe LLP

(57) ABSTRACT

A light emitting apparatus is provided. The light emitting apparatus includes a light transmissive envelope, a light source being in thermal communication with a heat sink, and a plurality of heat fins in thermal communication with the heat sink and extending in a direction such that the heat fins are adjacent the light transmissive envelope. The plurality of heat fins comprises a carbon nanotube filled polymer composite.

11 Claims, 5 Drawing Sheets

(56) References Cited

U.S. PATENT DOCUMENTS

| | | | | |
|---|---|---|---|---|
| 2006/0193130 | A1* | 8/2006 | Ishibashi | 362/227 |
| 2009/0195186 | A1 | 8/2009 | Guest et al. | |
| 2009/0262545 | A1* | 10/2009 | Amelung et al. | 362/487 |
| 2011/0128742 | A9* | 6/2011 | Yuen et al. | 362/294 |
| 2012/0002419 | A1* | 1/2012 | Zaderej et al. | 362/249.02 |
| 2012/0155059 | A1* | 6/2012 | Hoelen et al. | 362/84 |

FOREIGN PATENT DOCUMENTS

| | | | |
|---|---|---|---|
| WO | WO 2005028549 | A2 * | 3/2005 |
| WO | WO 2008/036560 | | 3/2008 |
| WO | WO 2009/068471 | | 6/2009 |
| WO | WO 2009/149263 | | 12/2009 |
| WO | WO 2010/038983 | | 4/2010 |

OTHER PUBLICATIONS

Database WPI, Week 201026, Thomson Scientific, London, GB, AN 2010-E00946, XP002633403 & WO 2010/038983 (Amoluxe Co Ltd), Apr. 8, 2010, abstract.

Database WPI, Week 201011, Thomson Scientific, London, GB, AN 2010-B04670, XP002633404 & KR 100 934 440 B1 (Choe Y), Dec. 29, 2009, abstract.

* cited by examiner

THERMAL CONDUCTIVITY OF COMMON MATERIALS

| MATERIAL | THERMAL CONDUCTIVITY W/m-K |
|---|---|
| Polymers | 0.2-0.3 |
| Fe, Pt, Pb, Al2O3 | 30-200 |
| Al | 200-300 |
| Cu, Ag, BN, C(Graphite) | 300-400 |
| C(Diamond), C(Carbon nanotube), C(Nanotube fiber) | 400-2500 |

TRANSPARENT THERMALLY CONDUCTIVE POLYMER COMPOSITES FOR LIGHT SOURCE THERMAL MANAGEMENT

This application claims the benefit of U.S. Provisional Application No. 61/294,231 filed Jan. 12, 2010. U.S. Provisional Application No. 61/294,231 filed Jan. 12, 2010 is incorporated herein by reference in its entirety.

BACKGROUND

The present exemplary embodiment relates to illumination devices, and particularly to illumination devices including light emitting diodes (LED). However, it is to be appreciated that the present exemplary embodiment is also amenable to other like applications.

BRIEF DESCRIPTION

Incandescent and halogen lamps are conventionally used as omni-directional, non-directional and directional light sources, especially in residential, hospitality, and retail lighting applications. Omni-directional lamps are intended to provide substantially uniform intensity distribution versus angle in the far field, greater than 1 meter away from the lamp, and find diverse applications such as in desk lamps, table lamps, decorative lamps, chandeliers, ceiling fixtures, and other applications where a uniform distribution of light in all directions is desired.

Recently, there has been market demand for light sources of higher energy efficiency than conventional light sources such as incandescent and halogen lamps. Compact fluorescent (CFL) lamps have steadily gained market share over the past ten years based on their high efficiency (~50-60 LPW) and long life (~5-10 kHr) relative to incandescent and halogen lamps (~10-25 LPW, 1-5 kHr), in spite of their relatively poorer color quality, warm-up time, dimmability and acquisition cost. Solid state light sources such as LEDs are more recently evolving into the primary choice for high efficiency omni-directional and directional light sources while both LEDs and OLEDs are being developed as choice sources for non-directional light sources. The lighting source of choice for high efficiency non-directional lighting is application dependent and can vary.

With reference to FIG. 1, a coordinate system is described which is used herein to describe the spatial distribution of illumination generated by an incandescent lamp or, more generally, by any lamp intended to produce omnidirectional illumination. The coordinate system is of the spherical coordinate system type, and is described in FIG. 1 with reference to an incandescent lamp L. For the purpose of describing the far field illumination distribution, the lamp L can be considered to be located at a point L0, which may for example coincide with the location of the incandescent filament. Adapting spherical coordinate notation conventionally employed in the geographic arts, a direction of illumination can be described by an elevation or latitude coordinate $\theta$ and an azimuth or longitude coordinate $\phi$. However, in a deviation from the geographic arts convention, the elevation or latitude coordinate $\theta$ used herein employs a range [0°, 180°] where: $\theta$=0° corresponds to "geographic north" or "N". This is convenient because it allows illumination along the direction $\theta$=0° to correspond to forward-directed light. The north direction, that is, the direction $\theta$=0°, is also referred to herein as the optical axis. Using this notation, $\theta$=180° corresponds to "geographic south" or "S" or, in the illumination context, to backward-directed light. The elevation or latitude $\theta$=90° corresponds to the "geographic equator" or, in the illumination context, to sideways-directed light.

With continuing reference to FIG. 1, for any given elevation or latitude $\theta_o$ an azimuth or longitude coordinate $\phi$ can also be defined, which is everywhere orthogonal to the elevation or latitude $\theta_o$. The azimuth or longitude coordinate $\phi$ has a range [0°, 360°], in accordance with geographic notation.

It will be appreciated that at precisely north or south, that is, at $\theta$=0° or at $\theta$=180° (in other words, along the optical axis), the azimuth or longitude coordinate has no meaning, or, perhaps more precisely, can be considered degenerate. Another "special" coordinate is 0=90° which defines the plane transverse to the optical axis which contains the light source (or, more precisely, contains the nominal position of the light source for far field calculations, for example the point L0 in the illustrative example shown in FIG. 1).

In practice, achieving uniform light intensity across the entire longitudinal span $\phi$=[0°, 360°] is typically not difficult, because it is straightforward to construct a light source with rotational symmetry about the optical axis (that is, about the axis) $\theta$=0°). For example, the incandescent lamp L suitably employs an incandescent filament located at coordinate center L0 which can be designed to emit substantially omnidirectional light, thus providing a uniform illumination distribution respective to the azimuth $\theta$ for any latitude.

However, achieving ideal omnidirectional illumination respective to the elevational or latitude coordinate $\theta$ is generally not practical. For example, the lamp L is constructed to fit into a standard "Edison base" lamp fixture, and toward this end the incandescent lamp L includes a threaded Edison base EB, which may for example be an E25, E26, or E27 lamp base where the numeral denotes the outer diameter of the screw turns on the base EB, in millimeters. The Edison base EB (or, more generally, any power input system located "behind" the light source) lies on the optical axis "behind" the light source position L0, and hence blocks backward illumination (that is, blocks illumination along the south latitude, that is, along $\theta$=180°), and so the incandescent lamp L cannot provide ideal omnidirectional light respective to the latitude coordinate $\theta$.

Nonetheless, commercial incandescent lamps are readily constructed which provide illumination across the latitude span $\theta$=[0°, 135°] which is uniform to within ±20% as specified in the Energy Star standard promulgated by the U.S. Department of Energy and the U.S. Environment Protection Agency. This is generally considered an acceptable illumination distribution uniformity for an omnidirectional lamp, although there is some interest in extending this span still further, such as to a latitude span of $\theta$=[0°, 150°] with ±10% uniformity. Such lamps with substantial uniformity over a large latitude range (for example, about $\theta$=[0°, 120°] or more preferably about $\theta$=[0°, 135°] or still more preferably about $\theta$=[0°, 150°]) are generally considered in the art to be omnidirectional lamps, even though the range of uniformity is less than [0°, 180°]. Similarly, directional lamps are defined as having at least 80% of its light within 0 to 120 degrees, encompassing 75% of the total $4\pi$ steradians of a sphere centered on the light source. Non-directional lamps do not meet the requirements of either directional or omni-directional lamps.

By comparison with incandescent and halogen lamps, solid-state lighting technologies such as light emitting diode (LED) devices are highly directional by nature. For example, an LED device, with or without encapsulation, typically emits in a directional Lambertian spatial intensity distribution having intensity that varies with cos ($\theta$) in the range $\theta$=[0°, 90°] and has zero intensity for 0>90°. A semiconductor laser is even more directional by nature, and indeed emits a distribution describable as essentially a beam of forward-directed light limited to a narrow cone around θ=0°.

Another consideration for omnidirectional lamps in general illumination applications is color quality. For white lamps, it is desired to render white light with a desired color temperature (for example, a "cool" white light, or a "warm" white light, with the desired color temperature being dependent upon application, geographic regional preference, or other individualized choice). The generated white light rendition should also have a high color rendering index (CRI), which can be thought of as a metric of the quality of "whiteness" of emitted light. Here again, incandescent and halogen lamps have had the advantage over solid state lighting. An incandescent filament, for example, can be constructed to produce good color temperature and CRI characteristics, whereas an LED device naturally produces approximately monochromatic light (e.g., red, or amber, or green, et cetera). By including a "white" phosphor coating on the LED, a white light rendition can be approximated, but the rendition is still generally inferior in color temperature and CRI as compared with incandescent and halogen lamps.

Yet another challenge with solid-state lighting is the need for auxiliary components such as electronics and heat sinking. Heat sinking is needed because LED devices are highly temperature-sensitive. Proper thermal management of LED devices is required to maintain operational stability and overall system reliability. Typically, this is addressed by placing a relatively large mass of heat sinking material (that is, a heat sink) contacting or otherwise in good thermal contact with the LED device. The space occupied by the heat sink blocks illumination and hence further limits the ability to generate an omnidirectional LED-based lamp. The heat sink preferably has a large volume and surface area in order to radiate heat away from the lamp—however, such an arrangement is problematic for an omnidirectional light source since a large portion of the angular range (for example, about θ=[0, 135°] or more preferably about θ=[0°, 150°]) is devoted to optical output, which limits the available volume and surface area. The need for on-hoard electronics further complicates the design. Typically, these difficulties are solved by accepting a tradeoff between angular range and heat sinking (for example, reducing the range of uniform light output to something closer to θ=[0°, 90°] and making the heat sink closer to a hemispherical element). Alternatively, the heat sink can be configured as a thermal conduction path rather than as a radiator, and the electronics and heat radiators or heat dissipation located in a remote mating lamp fixture. An example of such an arrangement is shown in Japanese publication JP 2004-186109 A2, which discloses a down light including a light source and a custom fixture containing the requisite electronics and the heat radiating elements for driving the light source. The lamp of JP 2004-186109 A2 is a "down light" and outputs light over a latitude range of θ~[0°, 90°] or smaller (where in this case the "north" direction is pointing "downward", i.e. away from the ceiling).

In spite of these challenges, attempts have been made to construct a one-piece LED-based omnidirectional light source. This is due to the benefits that solid state lighting exhibit over traditional light sources, such as lower energy consumption, longer lifetime, improved robustness, smaller size and faster switching. However, LEDs require more precise control of electrical current and heat management than traditional light sources. It is known that LED temperature should be kept low in order to ensure efficient light production, lumen maintenance over life, and high reliability. If heat cannot be removed quickly enough, the LED may become overheated, hindering the efficiency and service life thereof In prior art solutions of thermal management, the large volume, mass and surface area of the requisite heat fins results in an integral LED lamp having undesirably large mass and size, as well as poor uniformity of the light intensity distribution.

The thermal conductivity of the typical prior art material for thermal management of LED lamps, aluminum, is about 80-180 W/m-K depending on the alloy and the fabrication process. Use of polymer as the thermal management material could reduce the weight and cost of an LED replacement lamp if the thermal conductivity of the polymer could be increased. Recently, several polymer composite materials have been developed in efforts to improve thermal conductivity and overall system performance in LED applications. A thermally conductive polymer-filled composite has been introduced that combines good thermal conductivity (up to 25 W/m-K) with good heat distortion temperature (HDT) and processability. However, the composites are not transparent, and thereby would block illumination from a lamp. Alternatively, transparent electrically conductive polymer-filled composite thin films have been developed for use in touch-screens. However, these materials focus on electrical properties, and generally do not provide high thermal conductivity.

The present disclosure is directed to solving the weight, size and cost problems of thermal management in LED and OLED lamps and lighting systems, while simultaneously avoiding light blockage, by providing the relatively high thermal conductivity of heretofore optically opaque polymers in an optically transmissive polymer, and incorporating the design of the optically transmissive polymer into the LED or OLED lamp or system. This may include creating an all-in-one solution, integrating LED lighting, thermal transfer (heat sink), reflector options, and cooling options. Particularly, the present disclosure is directed to the optimization of thermal transfer in an integral LED based omnidirectional light source. An integral light source is generally a lamp or a lighting system that provides all of the functions required to accept electrical power from the mains supply and create and distribute light into an illumination pattern. The integral light source is typically comprised of an electrical driver, an LED or OLED light engine to convert the electricity to light, a system of optical components to distribute the light into a useful pattern, and a system of thermal management components to remove waste heat from the driver and the light engine and dissipate the heat to the ambient environment. Heat sink performance is a function of material, geometry, and heat transfer coefficients for convection and radiation to ambient. Generally, increasing the surface area of the heat sink by adding extended surfaces such as fins will improve heat sink thermal performance. However, since the objective of the heat sink in most LED and OLED applications is to provide the coolest possible temperature of the light engine and the driver, then it is usually desirable that the heat sink provide a very large surface area. The space occupied by the preferred heat sink design may interfere with the space required by the preferred optical system and therefore will block illumination and hence limit the illumination potential of the lamp or the lighting system. Therefore, an optimal thermal energy dissipation/spreader must incorporate high thermal conductivity along with optical transparency or translucency to ensure the dissipation/spreading surfaces will not block light radiating from the light source.

BRIEF SUMMARY

Embodiments are disclosed herein as illustrative examples. In accordance with one aspect of the present disclosure, a light emitting apparatus is provided. The light emitting apparatus includes a light transmissive envelope, a light source being in thermal communication with a heat sink, and a plurality of heat fins in thermal communication with the heat sink and extending in a direction such that the heat fins are adjacent the light transmissive envelope. The plurality of heat fins comprises a carbon nanotube filled polymer composite.

In accordance with another aspect, a light emitting device is provided that includes an LED light source mounted to a base, a light transmissive diffuser configured to diffuse and transmit light from the LED light source, and one or more thermally conductive heat fins in thermal communication with the base. The heat fins comprise a thermally conductive material including a carbon nanotube filled polymer composite.

In yet another embodiment, a light emitting device is provided. The light emitting device comprises a substrate having one or more organic light emitting elements with a first electrode formed thereon, one or more conductive layers, one or more organic light emitting layers disposed over the first electrode, a second electrode located over the light emitting layers, and an encapsulating cover located over the second electrode and affixed to the substrate. At least one of the substrate and the cover are comprised of a carbon nanotube filled polymer composite.

BRIEF DESCRIPTION OF THE DRAWINGS

The invention may take form in various components and arrangements of components, and in various process operations and arrangement of process operations. The drawings are only for purposes of illustrating embodiments and are not to be construed as limiting the invention.

DETAILED DESCRIPTION

The present disclosure is directed to solving the weight, size and cost problems of thermal management in LED and OLED lamps and lighting systems, while simultaneously avoiding light blockage, by providing the relatively high thermal conductivity of heretofore optically opaque polymers in an optically transmissive polymer, and incorporating the design of the optically transmissive polymer into the LED or OLED lamp or lighting system. This solution utalizes polymer composites filled with a relatively low density of high thermal conductivity carbon nanotubes such that the thermal conductivity of the composite polymer is comparable to that of aluminum, while the optical transmission is comparable to that of clear glass, so that the composite polymer may be used as heat fins and thermally conductive optical elements.

Figure 1:
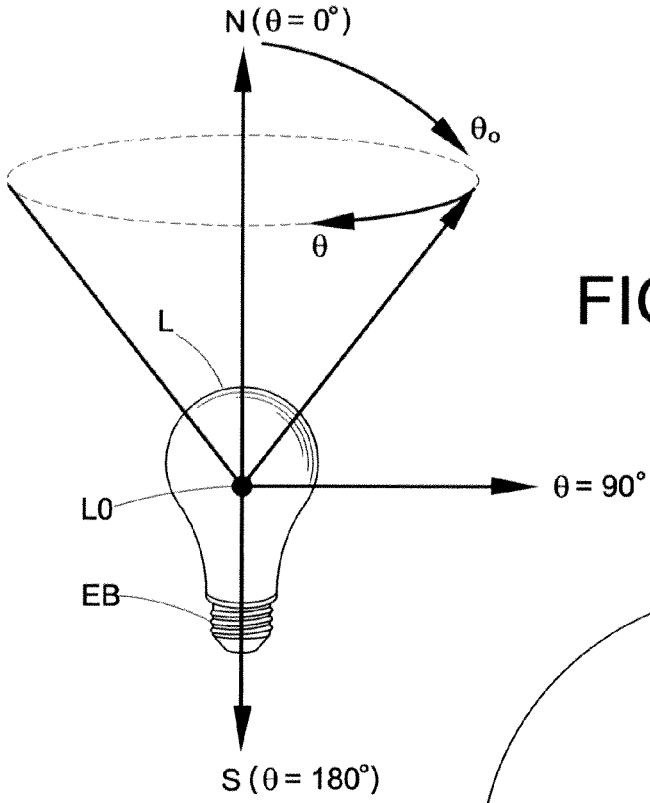
FIG. 1 diagrammatically shows, with reference to a conventional incandescent light bulb, a coordinate system that is used herein to describe illumination distributions.
Figure 2:
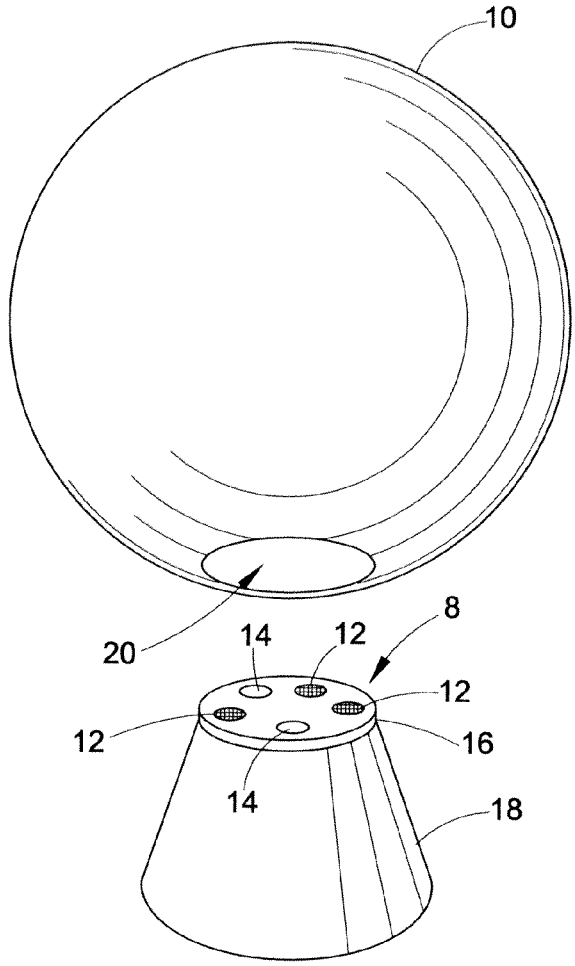
FIG. 2 diagrammatically shows a side view of an omnidirectional LED-based lamp employing a planar LED-based Lambertian light source and a spherical diffuser.

With reference to FIG. 2, an LED based lamp includes a planar LED-based Lambertian light source 8 and a light-transmissive spherical envelope 10 in a configuration that could be used in an LED lamp to provide an omni-directional illumination pattern to replace a general purpose incandescent light bulb. However, other shapes may be preferred in certain embodiments to provide other illumination patterns such as directional or non-directional illumination patterns. The planar LED-based Lambertian light source 8 is best seen in the partially disassembled view of FIG. 2 in which the diffuser 10 is pulled away and the planar LED-based Lambertian light source 8 is tilted into view. The planar LED-based Lambertian light source 8 includes one or more light emitting diode (LED) devices 12, 14, However, it is to be recognized that this disclosure does not simply cover use with LEDs, but organic LEDs (OLEDs) as well.

The illustrated light-transmissive envelope 10 is substantially hollow and has a spherical surface that diffuses light. In some embodiments, the spherical envelope 10 is comprised of glass, although a diffuser comprising another light-transmissive material, such as plastic, is also contemplated. The surface of the envelope 10 can be made light-diffusive in various ways, such as: frosting or other texturing to promote light diffusion; coating with a light-diffusive coating, such as a soft-white diffusive coating (available from General Electric Company, New York, USA) of a type used as a light-diffusive coating on the glass bulbs of some incandescent light bulbs; embedding light-scattering particles in the glass, plastic, or other material of the diffuser; various combinations thereof; or so forth.

The LED-based Lambertian light source 8 may comprise one or a plurality of light sources (LEDs) 12, 14. Laser LED devices are also contemplated for incorporation into the lamp.

The performance of an LED lamp can be quantified by its useful lifetime, as determined by its lumen maintenance and its reliability over time. Whereas incandescent and halogen lamps typically have lifetimes in the range ~1000 to 5000 hours, LED lamps are capable of >25,000 hours, and perhaps as much as 100,000 hours or more.

The temperature of the p-n junction in the semiconductor material from which the photons are generated is a significant factor in determining the lifetime of an LED lamp. Long lamp life is achieved at junction temperatures of about 100° C. or less, while severely shorter life occurs at about 150° C. or more, with a gradation of lifetime at intermediate temperatures. The power density dissipated in the semiconductor material of a typical high-brightness LED circa year 2009 (~1 Watt, 50-100 lumens, ~1×1 mm square) is about 100 Watt/$cm^2$. By comparison, the power dissipated in the ceramic envelope of a ceramic metal-halide (CMH) arctube is typically about 20-40 W/$cm^2$. Whereas, the ceramic in a CMH lamp is operated at about 1200-1400 K at its hottest spot, the semiconductor material of the LED device should be operated at about 400 K or less, in spite of having more than 2× higher power density than the CMH ceramic. The temperature differential between the hot spot in the lamp and the ambient into which the power must be dissipated is about 1000 K in the case of the CMH lamp, but only about 100 K for the LED lamp. Accordingly, the thermal management must be of order ten times more effective for LED lamps than for typical HID lamps.

The LED-based Lambertian light source 8 is mounted to a base 18 that may be both electrical and heat sinking. The LED devices are mounted in a planar orientation on a circuit board 16, optionally a metal core printed circuit board (MCPCB). Base element 18 provides support for the MCPCB and is thermally conductive (heat sinking). When designing a heat sink, the limiting thermal impedances in a passively cooled thermal circuit are typically the convective and radiative impedances to ambient air (that is, dissipation of heat into the ambient air). Both impedances are generally proportional to the surface area of the heat sink. In the case of a replacement lamp application, where the LED lamp must fit into the same space as the traditional Edison-type incandescent lamp being replaced, there is a fixed limit on the available amount of surface area exposed to ambient air. Therefore, it is advantageous to use as much of this available surface area as possible for heat dissipation into the ambient air.

Figure 3:
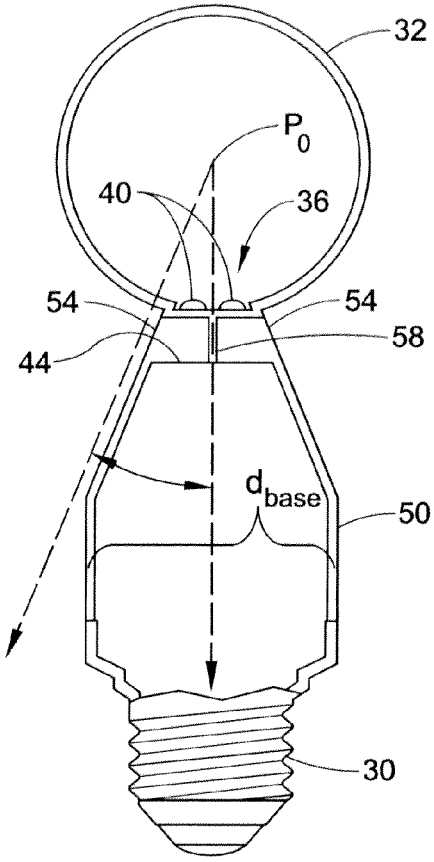
FIG. 3 illustrates a side view of two illustrative LED-based lamps employing the principles of the lamp of FIG. 2 further including an Edison base enabling installation in a conventional incandescent lamp socket.

Referring now to FIG. 3 components of this design, which are configured as a one-piece light-emitting apparatus, are illustrated. The LED-based lamp of FIG. 3 includes an Edison-type threaded base electrical connector 30 that is formed to be a direct replacement of the Edison base electrical connector of a conventional incandescent lamp. (It is also contemplated to employ another type of electrical connector, such as a bayonet mount of the type sometimes used for incandescent light bulbs in Europe). The lamp of FIG. 3 includes spherical or spheroidal diffusers 32, and respective planar LED-based light sources 36 arranged tangentially to a bottom portion of the respective spherical diffuser 32. The LED-based light source 36 is configured tangentially respective to the spherical or spheroidal diffusers 32, and include LED devices 40. In FIG. 3, the LED-based light source 36 includes a small number of LED devices 40 (two illustrated), and provides a substantially Lambertian light intensity distribution that is coupled with the spherical diffuser 32.

Figure 4:
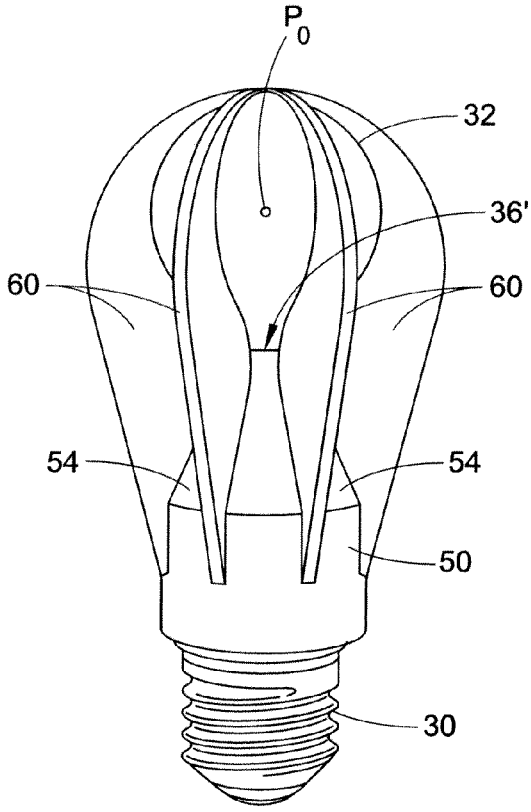
FIG. 4 illustrates a side perspective view of a retrofit LED-based light bulb substantially similar to the lamp of FIG. 3, but further including fins.

With continuing reference to FIG. 3, an electronic driver 44, is interposed between the planar LED light source 36 and the Edison base electrical connector 30, as shown in FIG. 4. The electronic driver 44 is contained in lamp base 50 with the balance of each base (that is, the portion of each base not occupied by the respective electronics) being made of a heat sinking material. The electronic driver 44 is sufficient, by itself, to convert the a.c. power received at the Edison base electrical connector 30 (for example, 110 volt a.c. of the type conventionally available at Edison-type lamp sockets in U.S. residential and office locales, or 220 volt a.c. of the type conventionally available at Edison-type lamp sockets in European residential and office locales) to a form suitable format to drive the LED-based light source 36. (It is also contemplated to employ another type of electrical connector, such as a bayonet mount of the type sometimes used for incandescent light bulbs in Europe).

It is desired to make the base 50 large in order to accommodate a large electronics volume and in order to provide adequate heat sinking, but the base is also preferably configured to minimize the blocking angle, i.e. to keep light at up to 30° uninterrupted These diverse considerations are accommodated in the respective bases 50 by employing a small receiving area for the LED-based light source sections 36 which is sized approximately the same as the LED-based light source, and having sides angled at less than the desired blocking angle (a truncated cone shape). The angled base sides extend away from the LED-based light source for a distance sufficient to enable the angled sides to meet with a cylindrical base portion of diameter $d_{base}$ which is large enough to accommodate the electronics.

It will be appreciated that the external shape of the lamps of FIGS. 3 and 4 is defined by the diffuser 32 the base 50 and the Edison-type threaded base electrical connector 30 are advantageously configured to have a form (that is, outward shape) similar to that of an Edison-type incandescent light bulb. The diffuser 32 defines the portion roughly corresponding to the "bulb" of the incandescent light bulb, the base 50 including angled sides 54 has some semblance to the base region of an Edison-type incandescent light bulb, and the Edison-type threaded base electrical connector 30 conforms with the Edison-type electrical connector standard.

The angle of the heat sink base helps maintain a uniform light distribution to high angles (for example, at least 150°). If the cutoff angle is >30°, it will be nearly impossible to have a uniform far field intensity distribution in the azimuthal angles (top to bottom of lamp). Also, if the cutoff angle is too shallow <15°, there will not be enough room in the rest of the lamp to contain the electronics and lamp base. An optimal angle of 20-30° is desirable to maintain the light distribution uniformity, while leaving space for the practical elements in the lamp. The present LED lamp provides a uniform output from 0° (above lamp) to 150° (below lamp) preferably 155°. This is an excellent replacement for traditional A19 incandescent light bulb.

As displayed in FIG. 4, a plurality of heat-radiating fins 60 may be included in thermal communication with the base 50. Thus, the lamp of FIG. 4 is an integrated light emitting apparatus adapted to be installed in a lighting fixture (not shown) by connecting the illustrated Edison-type electrical connector 30 (or a bayonet connector or other type of electrical connector included in the integrated light-emitting apparatus) to a mating receptacle of the lighting fixture. The integrated light emitting apparatus of FIG. 4 is a self-contained omni-directional light emitting apparatus that does not rely upon the lighting fixture for heat sinking or driving electronics. As such, the one-piece light emitting apparatus of FIG. 4 is suitable, for example, as a retrofit light bulb. Fins 60 enhance radiative heat transfer from the base 50 to the air or other surrounding ambient. Essentially, the heat sink of base 50 includes extensions comprising fins 60 that extend over the spherical diffuser 32 to further enhance radiation and convection to the ambient of heat generated by the LED chips of the LED based lighting unit 36'. Fins 60 extend latitudinally toward the north pole of the lamp $\theta=0°$ adjacent to the spherical diffuser 14. The fins 60 are shaped to comport with the desired outward shape of an Edison-type incandescent light bulb. Advantageously, the design provides an LED based light source that fits within the ANSE outline for an A-19 bulb. The LED outer bulb is functional as a dual purpose light transmitter and heat dissipation surface. Fins 60 couple with the base at the angled sides 54, 56. Furthermore, there is no specific requirement for fin shape.

Figure 5A:
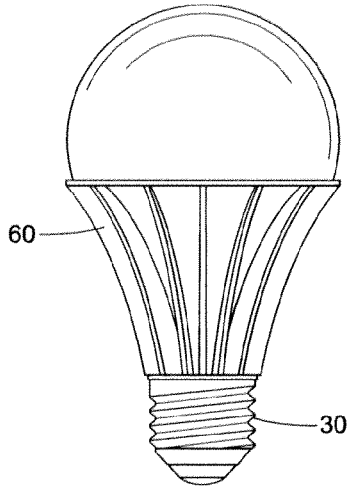
FIG. 5a (PRIOR ART)
FIG. 5*a* illustrates a prior art LED replacement lamp for omni-directional incandescent lamp applications.
Figure 5B:
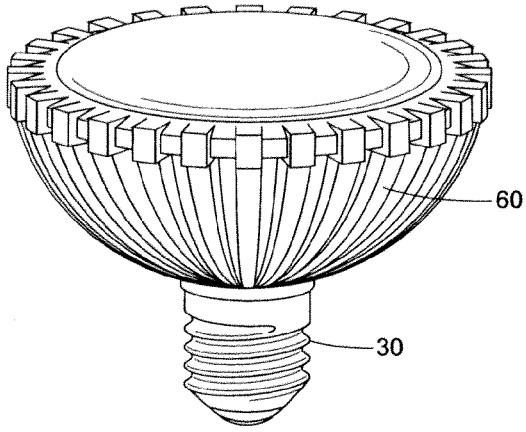
FIG. 5b (PRIOR ART)
FIG. 5*b* illustrates a prior art LED replacement lamp for directional incandescent lamp applications.

The heat fins 60 of FIG. 4 can be comprised of aluminum, or stainless steel, or another metal or metal alloy having acceptably high thermal conductivity. The heat fins 60 may have the natural color of the substrate metal, or they may be painted or coated black or another color to enhance thermal radiation, or they may be painted or coated white or another light color to enhance the reflectance of visible light. However, metal heat fins must be minimized in size, or positioned relative to the light source in order to reduce the adverse impact on the light distribution pattern due to the absorption and scattering of light by the heat fins. In the application of an integral replacement lamp, having a regulated limitation on the size and shape of the lamp, such restrictions on the size, shape and location of the heat fins results in either an undesirable reduction of the light output and distortion of the light distribution, or a reduction in the cooling provided by the heat fins to the LED or OLED light source. In the case of an integral LED lamp intended to replace an omni-directional incandescent lamp, the compromise that has been chosen in prior art embodiments is to severely limit the range of angles of the distribution of the light output, as depicted in FIGS. 5*a*-*b*. In the case of most LED replacement lamps for omni-directional incandescent lamp applications, depicted in FIG. 5*a*, the light distribution covers only about ½ of the total 4-π steradians of the preferred distribution, while the remaining ½ of the angular range is blocked by the heat fins 60. In the case of most LED replacement lamps for directional incandescent and halogen lamp applications, exemplified in FIG. 5*b*, the heat fins 60 are precluded from about ½ of the total 4-π steradians so that the light distribution may be emitted without distortion from the heat fins 60.

According to one embodiment, the heat fins 60 in FIG. 4 are constructed of a thermally conductive material, and more preferably thermally conductive carbon nanotubes composite. Carbon nanotubes (CNTs) are allotropes of carbon having a cylindrical nanostructure. In general, carbon nanotubes are elongated tubular bodies that are typically only a few atoms in circumference. Both single-walled nanotubes (SWNTs) as well as multi-walled carbon nanotubes (MWNTs) have been recognized. MWNTs have a central tubule surrounding graphitic layers whereas SWNTs have only one tubule and no graphitic layers. CNTs possess desirable strength, weight, and electrical conductivity. It has been found that CNTs conduct heat and electricity better than copper or gold and have 100 times the tensile strength of steel, with only ⅙ of the weight. The range of thermal conductivity of CNT is typically 1000-6000 W/m-K at room temperature or slightly higher and can be a further order of magnitude higher at lower temperatures. However, carbon nanotubes exhibit poor dispersion and agglomeration in host materials making use of CNTs in composite materials difficult. U.S. Pat. No. 7,094,367 and U.S. Pat. No. 7,479,516, incorporated herein by reference, describe some common approaches for dispersing CNTs in host polymer matrices, such as poly (methyl methacrylate), nylon, polyethylene, epoxy resin, polyisoprene, sbs rubber, polydicyclopentadiene, polytetrafluoroethulene, poly(phenylene sulfide), poly(phenylene oxide), silicone, polyketone, and thermoplastics, etc., that include solution mixing of polymer and carbon nanotubes, a combination of sonication and melt processing, melt blending, in-situ polymerization in the presence of nanotubes.

Another approach for dispersing CNTs in host polymer matrices includes weaving long stands of SWCNTs into a cloth forming a contiguous structure of high thermal conductivity carbon nanotubes. As introduced above, SWNT's are unique one-dimensional conductors with dimensions of about 1 nanometer in diameter and several micrometers in length. Long strand SWCNTs are available commercially, such as from Eikos, Inc. Multiple layers of SWCNT cloth may be produced with 90-95% opening if the SWNT's are embedded in a layered structure within a transparent polymer matrix such that each strand/thread of SWCNT in any cloth is situated perfectly on top of the same thread as the cloth below. This configuration provides a substantially transparent high thermal conductivity polymer-CNT composite. Although the CNT cloth may not be transparent, the low volume fraction and vertical alignment of the cloths provide sufficient transparency when looking at the polymer normally and at large angles off of normal.

Figures 6, 8:
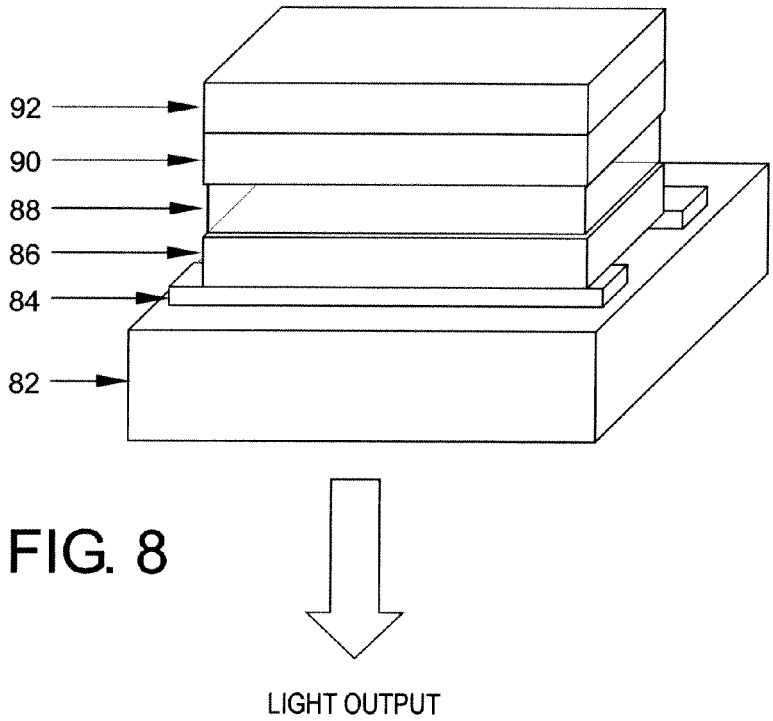
FIG. 6 shows a table of thermal conductivity of commonly used material.
FIG. 8 illustrates an organic light emitting device according to the aspects of the present disclosure.
Figure 7A:
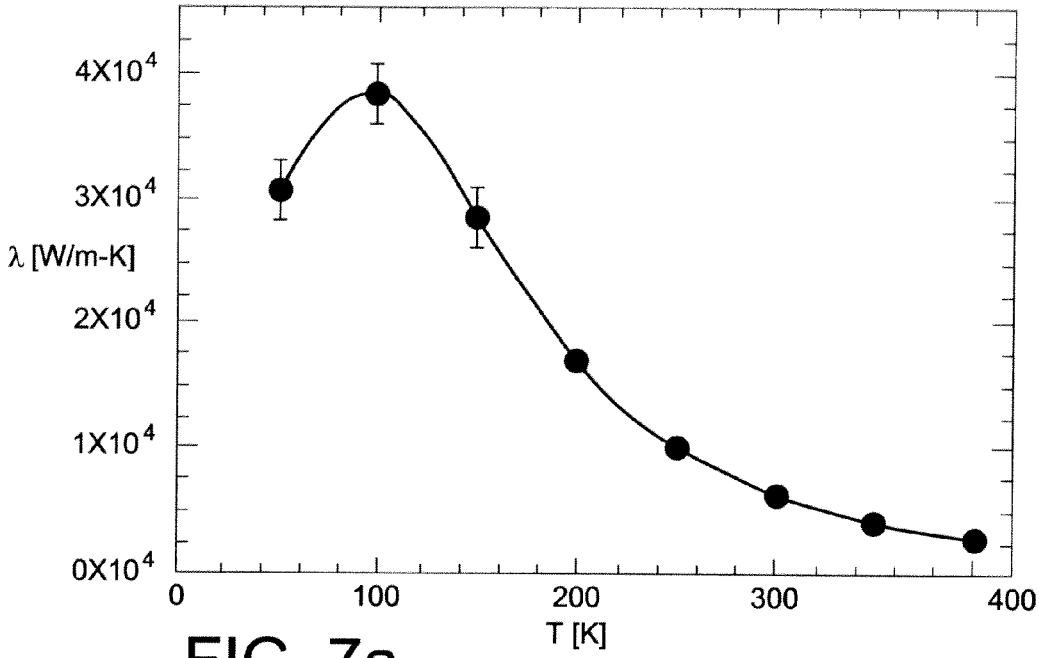
FIG. 7*a* graphically displays the carbon nanotube thermal conductivity as a function of temperature K.
Figure 7B:
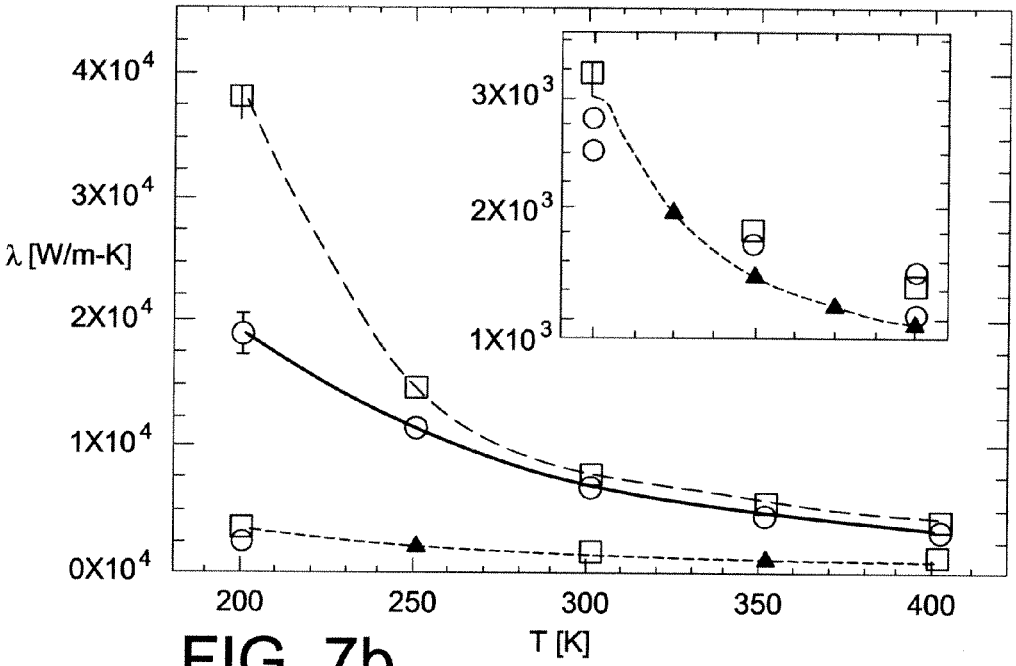
FIG. 7*b* graphically displays the thermal conductivity for a carbon nanotubes (solid line), in comparison to a constrained graphite monolayer (dash-dotted line), and the basal plane of AA graphite (dotted line) at temperatures between 200 and 400 K.

The carbon nanotube composite disclosed herein is thermally conductive and transparent so as not to distort or reduce the illumination pattern of the lamp. The thermal conductivity (k) is between about 10-1000 W/m-K, more preferably between about 20-300 W/m-K, having transmittance of visible light at least about 90%, more preferably at least 95% when the carbon nanotubes loading is between about 2-10 wt %. As shown in FIG. 6, the potential carbon nanotubes-tilled polymer thermal characteristics are greatly improved over general heat sinks, and are almost comparable to those of metals. Berber et al, fully incorporated herein by reference, graphically display various carbon nanotubes composite characteristics, illustrated in FIGS. 7*a* and 7*b*. FIG. 7*a* displays the CNT thermal conductivity as a function of temperature K. As displayed, the CNT reach peak conductivity at 100 K (37000 W/m-K), then the conductivity gradually decreases. At room temperature, the conductivity is about 6600 W/m-K. FIG. 7*b* illustrates the thermal conductivity for a carbon nanotubes (solid line), in comparison to a constrained graphite monolayer (dash-dotted line), and the basal plane of AA graphite (dotted line) at temperatures between 200 and 400 K. The calculated values (solid triangles) are compared to the experimental data (open circles), (open diamonds) and (open squares) for graphite. The graph illustrate that an isolated nanotubes shows a very similar thermal transport behavior as a hypothetical isolated graphene monolayer.

The electrical characteristics of the CNT composite depend largely on the nanotubes mass fraction (%). U.S. Pat. No. 7,479,516 B2, incorporated herein by reference, teaches the conductivity levels for electrical applications. '516 discloses that very small wt % (0.03) of SWNT loading in polymer for electrical applications such as electrostatic dissipation and electrostatic shielding and 3 wt. % of SWNT loading is adequate for EMI shielding. Therefore, the host polymer's preferred physical properties and processability would be minimally compromised within the nanocomposite.

In a carbon nanotube polymer composite the thermal conductivity relationship is expected to be as follows:

$$k_{composite} \approx (WT\ \%\ CNT) \times k_{cnt} + (WT\ \%\ PMR) \times k_{pmr}$$

Where $k_{composite}$ is the resultant thermal conductivity of the composite and is expected to be 10-1000 W/m-K. $k_{cnt}$ is the thermal conductivity of the carbon nanotube used. $k_{pmr}$ is the thermal conductivity of the polymer matrix used. WT % CNT is the weight percent loading of the carbon nanotube in the composite and is expected to be 2-10%. WT % PMR is the weight percent loading of the polymer matrix in the composite. The transparency of the composite is expected to be ~95%, as follows:

$$T_{composite} = 1 - R_{composite} - A_{composite}$$

$$A_{composite} \approx (\text{VOL}\ \%\ CNT) \times aCNT + (\text{VOL}\ \%\ PMR) \times A_{pmr}$$

Where the absorbance of the CNT is ~100% and the absorbance of the polymer matrix is ~0%, so that the absorbance of the composite is:

$$A_{composite} \approx (\text{VOL}\ \%\ CNT)/(\text{VOL}\ \%\ PMR) \sim 2\text{-}10\%$$

In general, carbon nanotubes are randomly oriented in a polymeric host. However, it is also contemplated to form high thermal conductivity carbon nanotubes filled polymer composite as a CNT layer in which the carbon nanotubes are biased toward a selected orientation parallel with the plane of the thermally conductive material, as disclosed in U.S. Ser. No. 61/320,431, filed Apr. 2, 2010 and the full utility application thereof, U.S. Ser. No. 12/979,529, filed Dec. 28, 2010, fully incorporated herein by reference. Such an orientation can enhance the lateral thermal conductivity as compared with the "through-layer" thermal conductivity. If additionally the carbon nanotubes are biased toward a selected orientation parallel with the plane of the thermally conductive material, then the tensor has further components, and if the selected orientation is parallel with a described direction of thermal flow then the efficiency of ultimate radiative/convective heat sinking can be still further enhanced. Once way of achieving this preferential orientation of the carbon nanotubes is by applying an electric field E during the spray coating. More generally, an external energy field is applied during the spray coating to impart anon-random orientation to the carbon nanotubes disposed in the polymeric host. According to another way of achieving preferential orientation of the carbon nanotubes is to disposed the thermally conductive layer on the heat sink body using painting, with the pain strokes being drawn along the preferred orientation so as to mechanically bias the carbon nanotubes toward the preferred orientation.

In accordance with another aspect of the present disclosure, the high thermal conductivity carbon nanotubes filled polymer composite is used with an organic light emitting diode (OLED). FIG. 8 displays a bottom emitting OLED architecture. While FIG. 8 only shows a simple configuration, generically OLED devices include a substrate 80 having one or more OLED light-emitting elements including an anode formed thereon 84, one or more conductive layers 86, such as a hole injection layer, located over the anode 84, one or more organic light-emitting layers 88, an electron transport layer 90, and a cathode 92. An OLED device may be top-emitting, where the light-emitting elements are intended to emit through a cover over the cathode, and/or bottom-emitting, where the light-emitting elements are intended to emit through the substrate. Accordingly, in the case of a bottom-emitting OLED device, the substrate 82 and anode layer 84 must be largely transparent, and in the case of a top-emitting OLED device, the cover and second cathode 92 must be largely transparent. OLEDs can generate efficient, high brightness displays; however, heat generated during the operation of the display can limit the lifetime of the display, since the light emitting materials degrade more rapidly when used at higher temperatures. Therefore, according to the present embodiment, carbon nanotubes filled polymer composites may be implemented as the substrate and/or the cover to create front and/or back plane heat spreading and dissipation surfaces.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A light emitting apparatus comprising:

a light transmissive envelope;

a light source being in thermal communication with a heat sink;

a plurality of heat fins in thermal communication with said heat sink and extending in a direction such that the heat fins are adjacent to said light transmissive envelope, wherein said plurality of heat fins comprises a carbon nanotube filled polymer composite; and wherein said apparatus has a longitudinal axis dissecting said envelope and said heat sink, and wherein said heat sink has a light blocking angle of less than 30° as measured from said longitudinal axis at a point of exit from said heat sink.

2. The light emitting apparatus of claim 1, wherein the thermal conductivity of the apparatus is between about 10-1000 W/m-K.

3. The light emitting apparatus of claim 1, wherein the thermal conductivity of the apparatus is about 20-300 W/m-k.

4. The light emitting apparatus of claim 1, wherein said heat fins have at least about 90% optical transmittance.

5. The light emitting apparatus of claim 1, wherein the carbon nanotube loading is between about 2-10 wt %.

6. The light emitting apparatus of claim 1, wherein said carbon nanotubes are single-walled carbon nanotubes (SWNT).

7. The light emitting apparatus of claim 6, wherein said carbon nanotube filled polymer composite comprises a cloth weaved with long strands of single-walled carbon nanotubes.

8. The light emitting apparatus of claim 7, wherein said nanotubes filled polymer composite comprises multiple layers of single walled carbon nanotube weaved cloth.

9. The light emitting apparatus of claim 8, wherein said single walled carbon nanotubes are embedded in the multiple layers within a transparent polymer matrix such that each single walled nanotube strand is positioned on top of the same strand of nanotube as a cloth position below.

10. The light emitting apparatus of claim 1, wherein said at least one light source comprises at least one of an LED and OLED.

11. The light emitting apparatus of claim 1 wherein said heat fins communicate optically with light emitted from said light transmissive envelope.

* * * * *